United States Patent [19]

Stansky, Jr.

[11] 4,207,173

[45] Jun. 10, 1980

[54] SWEETENING OF HYDROCARBON DISTILLATES UTILIZING A TETRA-ALKYL GUANIDINE WITH PHTHALOCYANINE CATALYST

[75] Inventor: Charles A. Stansky, Jr., Elk Grove Village, Ill.

[73] Assignee: UOP Inc., Des Plaines, Ill.

[21] Appl. No.: 830,932

[22] Filed: Sep. 6, 1977

Related U.S. Application Data

[63] Continuation-in-part of Ser. No. 663,879, Mar. 4, 1976, abandoned.

[51] Int. Cl.[2] ..... C10G 27/06

[52] U.S. Cl. ..... 208/207

[58] Field of Search ..... 208/206, 207

[56] References Cited

U.S. PATENT DOCUMENTS

| | | | |
|---|---|---|---|
| 2,983,674 | 5/1961 | Bauer | 208/206 |
| 2,988,500 | 6/1961 | Gleim et al. | 208/206 |

*Primary Examiner*—George Crasanakis

*Attorney, Agent, or Firm*—James R. Hoatson, Jr.; Robert W. Welch; William H. Page, II

[57] ABSTRACT

An improved process for sweetening of sour hydrocarbons in a fixed bed treating process wherein the hydrocarbons containing mercaptans contact a phthalocyanine catalyst on charcoal in the presence of a basic medium and oxygen. The improvement is use of a tetra-alkyl guanidine to supply the basic medium, instead of the aqueous sodium hydroxide solution customarily used.

6 Claims, No Drawings

SWEETENING OF HYDROCARBON DISTILLATES UTILIZING A TETRA-ALKYL GUANIDINE WITH PHTHALOCYANINE CATALYST

CROSS REFERENCE TO RELATED APPLICATIONS

This application is a continuation-in-part of my copending application U.S. Ser. No. 663,879, filed on Mar. 4, 1976, now abandoned, the teachings of which are incorporated herein by reference.

BACKGROUND OF THE INVENTION

1. Field of the Invention

The invention relates to an improvement in the treatment of hydrocarbon distillates, more particularly to an improved method of sweetening sour hydrocarbon distillates by oxidizing mercaptans in the distillate to disulfides in the presence of a phthalocyanine catalyst on a charcoal carrier in the presence of a basic medium and oxygen.

2. Prior Art

Sweetening of sour hydrocarbons is well known in the petroleum refining arts. Processes abound relating to the treatment of petroleum distillates such as sour gasoline, cracked gasoline, straight run gasoline, naphtha, jet fuel, kerosene, fuel oil, etc.

The prime offender in many hydrocarbon distillates is mercaptan sulfur, RSH. Mercaptan sulfur can be successfully removed by hydrotreating, using a catalyst containing Co, Mo, etc., on a carrier such as alumina, at high temperatures under high hydrogen pressures. This hydrotreating will convert mercaptan sulfur to $H_2S$ which can be removed from normally liquid hydrocarbon fractions by distillation.

Hydrotreating is relatively expensive, and many petroleum products can contain relatively high sulfur levels, as long as the sulfur is not in the form of a mercaptan. The mercaptans are objectionable because of their strong odor, and because they are more corrosive. For many processes, it is sufficient if the mercaptans are converted to disulfides, RSSH, or RSSR.

A process for the fixed bed sweetening of hydrocarbon distillates is shown in U.S. Pat. No. 2,988,500 (Class 208-206), the teachings of which are incorporated by reference. In this patent, a novel catalyst was used to oxidize mercaptans to disulfides. The novel catalyst disclosed in this patent was cobalt phthalocyanine sulfonate composited with a charcoal carrier. A mixture of sour kerosene, aqueous NaOH solution, and air were passed over the catalyst to convert mercaptan sulfur to a level low enough that the kerosene product recovered would be doctor sweet. The treating reaction was effected in the presence of an alkaline reagent. The patentee taught that any suitable alkaline reagent could be used, and taught that the preferred reagents were sodium hydroxide and potassium hydroxide. Other reagents considered possible were aqueous solutions of lithium hydroxide, rubidium hydroxide, and cesium hydroxide.

Another treating process, inhibitor sweetening, was disclosed in U.S. Pat. No. 2,744,854 (Class 496-29), the teachings of which are incorporated by reference. The sweetening reaction was always accomplished in storage tanks, rather than in a reactor vessel. Thus, reaction times of several days would be necessary to complete the conversion of mercaptan sulfur to disulfides. There is extremely detailed and broad teaching in this patent as to the type of basic reagent which may be used to facilitate the sweetening reaction. Both organic and inorganic bases are taught, though from the examples, use of a phenylene diamine is preferred. Optionally, a metal chelate may be added to speed up the sweetening which occurs in the storage tank. In the specific teachings on basic compounds which may be used in addition to sodium hydroxide or potassium hydroxide, the patentee teaches over 50 different compounds and classes of compounds which serve as basic reagents.

Another inhibitor sweetening process is disclosed in U.S. Pat. No. 2,983,674 (Class 208-207), the teachings of which are incorporated by reference. This reference discloses that guanidines may be used in the inhibitor sweetening process to supplement the phenylene diamines used in this process. The number of guanidines disclosed is impressive going from column 2, line 70 to column 4, line 17. The patentee stated that no inoperable guanidine had been found and that all were operable. Many examples disclosed use of tetra-alkyl guanidines.

Although inhibitor sweetening and phthalocyanine catalyst oxidation both decrease the mercaptan content of a fuel, the means by which this is accomplished are different in the two cases. Consequently, those factors which control the process in one case cannot be considered as applicable to the other. The two processes must be considered as dissimilar.

The phthalocyanine catalyzed process carried out one reaction: the conversion of mercaptans to disulfides. This is accomplished by use of a chelated metal catalyst which, in commercial operation, is in a separate phase insoluble in the fuel. The reactions take place at the interface and consequently the process is susceptible to surface active ingredients.

In contrast, inhibitor sweetening involves several reactions, with disulfide formation accounting for, at most, two thirds of the mercaptan converted. At least one third of the mercaptan is consumed by interaction with olefins which must be present for sweetening to occur. These reactions involve species as intermediates called "free radicals" which are not observed in the phthalocyanine set of reactions. The inhibitor sweetening reactions generally are carried out in a single phase (hydrocarbon) with a catalyst, a specific type of organic polyamine, miscible in the hydrocarbon.

The two processes proceed under such different conditions, with different intermediates and with different products formed, that the two must be considered separate systems.

It is possible to pin-point the specific portions of the two processes at which the reactions with a basic material, such as a tetra-alkyl guanidine come into play. In case of phthalocyanine catalyzed oxidation, the function of the base is to convert the mercaptan to the corresponding anion:

$$RSH \rightarrow RS$$

This is accomplished by such strong bases as sodium hydroxide and guanidine. A strong base is essential for the catalyst will bring the mercaptan in play only in the ionized or anion form (RS).

In case of inhibitor sweetening, the function of the base is to bring about the following reaction:

$$R'OOH + 2RSH \rightarrow R'OH + H_2O + RSSR$$

A hydroperoxide (R'OOH) of rather complicated structure is formed as intermediate, and this oxidant converts mercaptan into disulfide. The reaction requires the presence of a base, and there are a number available.

An inspection of the actions of the base in the two processes reveals that the functions are different. Consequently one cannot reliably predict the effect of a given base from one process to the other.

The substitution of one base for another in the two processes does not always work. For example, an organic amine ($R_3N$) is suitable to carry out inhibitor sweetening, perhaps not as well as use of sodium hydroxide but still acceptable. In fact, an amine is incorporated in a commercial product (UOP 5-S) to impart the basicity needed for inhibitor sweetening.

In contrast, an organic amine is not only ineffective but deleterious to the process with phthalocyanine catalyst. In other words, it is impossible to predict the effect in the phthalocyanine system from results from inhibitor sweetening.

Inhibitor sweetening can proceed with bases which are generally considered as "weak". Phthalocyanine reactions require a "strong" or "stronger" base. Since the amine $R_3N$ is much "weaker" than a tetralkyl guanidine, the preceding observations can be explained.

In consideration of various bases, a strength is assigned to each base as a single attribute. This actually is not the case, for the basicity, and likewise acidity, is an intricate relationship of parts. For example, a concept has developed of "hard and soft" acids and bases which separates acids and bases into classes (R. G. Pearson, J. Chem. Educ., 45 581 (1968) and 45 643 (1968)). In other words, there is no one property of a base which carries over into all cases.

A similar conclusion is made with the Lewis definition of acids and bases, particularly the role of acids and bases as catalysts (see Kirk Othmer Encyclopedia of Chemical Technology, Second Edition, Vol. 1, pages 118–22).

Literature reports in general (for example, A. Frost and R. Pearson, Kinetics and Mechanism, John Wiley and Sons, Inc.) that it is difficult to correlate efficiencies of various bases for different reactions. The prediction of efficiencies should be even more laborious and uncertain.

A "weak" base is suitable for use in inhibitor sweetening; an amine $R_3N$ is moderately effective. One would expect an ammonium hydroxide solution to be similarly effective; generally, this is not the case. One can develop a concept to predict basicity effects, but they generally do not have universal application.

In the phthalocyanine system, an ammonium hydroxide solution likewise is of such low effectiveness that it has no practical utility.

On the basis of the foregoing discussion one can conclude that the two mercaptan conversion processes, inhibitor sweetening and phthalocyanine catalyzed oxidation, are two dissimilar systems and bear little resemblance to each other. Consequently there is no basis to propose predictability as to the effect of a given alkaline material on the system.

The fixed bed sweetening process has enjoyed worldwide commercial success. Despite the great acceptance of fixed bed sweetening by refining industry, there are still a few areas in which attempts have been made to improve the process. Specifically, the practice of using aqueous sodium hydroxide solutions to provide the basic medium required for oxidizing mercaptans to disulfides has resulted in a caustic disposal problem. Eventually the caustic solution used in a fixed bed unit becomes unsuitable for further use. Most common reason for discarding of caustic solutions is that various toxins or catalyst poisons, generated by the oxidation reaction, accumulate in the caustic. Thus, for a number of reasons the caustic commonly used in fixed bed sweetening processes must be discarded. Although sodium hydroxide is a very inexpensive chemical to buy, it is becoming a relatively expensive chemical to throw away, because of concern about pollution.

Also of concern to refiners is the danger that some of the caustic solution will somehow find its way into the final product. For some uses, e.g., jet fuel, neither sodium hydroxide nor water may be tolerated in the product. Elaborate measures are taken to make sure that the kerosene product destined for use as jet fuel will not contain either water or NaOH. The solution commonly used is to water-wash the kerosene effluent from the fixed bed treating process to remove sodium hydroxide solution. The water-washed kerosene is then passed through a bed of salt, so that the salt will react with any water contained in the hydrocarbon, and from a brine which will remain behind. Finally, the kerosene is passed through a bed of clay or sand to remove the last traces of water or brine solution which may be in the product. Although effective, such elaborate measures add to the cost of treating and increase the capital expenditure required to build a plant for the treating of fuels where the presence of small amounts of aqueous sodium hydroxide solutions is objectionable.

Other problems which have been encountered in the fixed bed sweetening process are the occasional plugging of the catalyst bed due to formation of soaps. A number of hydrocarbon distillates contained naphthenic acids, and the naphthenic acids reacted with aqueous sodium hydroxide to form a soap which forms a gel with the hydrocarbon which in turn plugged the charcoal bed. It has been necessary to put in caustic prewashes to remove these naphthenic acids from feeds containing them, so that the feed to the fixed bed sweetening unit will be substantially free of naphthenic acids. The typical naphthenic acid prewash is a large vessel filled with a dilute solution of sodium hydroxide. While such a vessel is efficient, and relatively inexpensive, it still adds to the cost of operating a fixed bed treating process.

Because of these difficulties encountered with some feedstocks, and some product specifications, I tried to find some way to eliminate these problems entirely, rather than add on an extra step upstream or downstream of existing fixed bed treating units. My investigation showed that most of the problems were caused by either something in the feed reacting with the aqueous sodium hydroxide solution used as a basic medium, or caused by remnants of the basic medium appearing in the product. I discovered a replacement for the sodium hydroxide solutions currently used in fixed bed treating processes. The replacement provided a uniquely satisfactory substitute for customarily used basic solutions. The material I discovered was tetra-alkyl guanidines.

BRIEF SUMMARY OF THE INVENTION

Accordingly the present invention provides in a process for treating a sour hydrocarbon distillate containing mercaptans by passing the distillate and an oxidizing agent over a fixed bed of a phthalocyanine catalyst composited with a carbon carrier in the presence of an alkaline medium, the improvement which comprises use of a tetra-alkyl guanidine as the alkaline medium.

In addition to eliminating some of the problems caused by the prior art sodium hydroxide solutions, I found that there was an unexpected benefit obtained by using tetra-alkyl guanidine as a basic medium. This benefit was an unexpected and surprising increase in apparent catalytic activity of the fixed bed sweetening unit. The use of tetra-alkyl guanidine permitted significantly improved mercaptan conversion to be effected in a fixed bed sweetening process. Use of tetra-alkyl guanidines is also beneficial in that the quanidines remain in the hydrocarbon phase and pass into storage tanks used for the hydrocarbons. The guanidines act to suppress color degradation in storage, and may also act as a corrosion inhibitor. Further, the guanidines do not change the color of the hydrocarbon product, this is in contrast to some of the phenylene diamines which impart a red color to the product.

DETAILED DESCRIPTION

An excellent discussion of the fixed bed sweetening of hydrocarbons is disclosed in U.S. Pat. No. 2,988,500, previously mentioned and incorporated by reference. All things taught in this patent can be used to good effect in practicing the present invention, with the substitution of a tetra-alkyl guanidine for the alkaline reagent of that patent.

The tetra-alkyl guanidine is preferably tetramethyl guanidine. Instead of four methyl groups, four ethyl, propyl, butyl, etc., groups may be used, or guanidines containing alkyl groups of varying chain lengths can also be used. Tetramethyl guanidine is preferred because it is readily available and inexpensive. Another advantage of the tetramethyl guanidine is that it can react with light and heavy naphthenic acids, phenols, etc., without forming soap-like salts. The reaction product of the guanidine and the naphthenic acids is soluble in hydrocarbon medium, so it does not plug-up the catalyst bed. This is in contrast to the reaction product of naphthenic acids with sodium hydroxide in aqueous solution, which forms soaps and gels which completely plug-up and render ineffective a catalyst bed. Also, emulsion problems are eliminated because the sodium salts are eliminated. Emulsions cause water to be carried into storage tanks causing an excess of water in the tank. These soaps can also carry sodium and water into the finished product which are not desirable.

Because of the vast number and variety of crude stocks which are being treated, it may be desirable to use heavier alkyl guanidines to treat very heavy charge stocks. In general, the longer the alkyl groups the more soluble will be the guanidine in the hydrocarbon. My experiments have shown, however, that even the lightest of the tetra-alkyl guanidines can do a very effective sweetening job at such low concentrations that it is completely soluble in the hydrocarbon oil treated, such as a kerosene.

The concentration of the tetra-alkyl guanidine should be sufficient to provide the basic medium necessary for these catalytic sweetening reactions to occur. The tetra-alkyl guanidine is preferably added continuously to the hydrocarbon to be treated, or alternatively, it may be placed in an aqueous or alcoholic solution which is periodically pumped over a fixed bed of catalyst to wet the surface thereof, with basic solution.

The catalyst used can be any catalyst which will speed up the rate of mercaptan oxidation in the presence of an alkaline reagent enough to permit sweetening of a sour hydrocarbon distillate over a fixed bed of the catalyst. Some metal chelates possess sufficient activity to permit their use as in such a process. Preferred among the metal chelates are the phthalocyanines. Especially preferred are the monosulfonated derivatives of cobalt phthalocyanine. The sulfonation of the cobalt phthalocyanine makes the material soluble enough in various solvents to permit the impregnation of a fixed bed of charcoal with the catalyst. The monosulfonate derivative is preferred because the more highly sulfonated derivatives are more soluble in the hydrocarbon means to be treated, permitting the leaching away of catalyst from the bed. Recent work done with polyphthalocyanine catalysts, and mixtures of different metal phthalocyanines, indicates that these catalysts too may be acceptable for use in the present invention, although forming no part thereof.

The catalyst material may be composited with any suitable form of charcoal by conventional means. An excellent way of preparing the catalyst is to dissolve, e.g., cobalt phthalocyanine monosulfonate in methanol and pass the methanolcatalyst solution repeatedly over a bed of activated charcoal. The precise type of catalyst used, its method of preparation and its incorporation onto a bed of charcoal support form no part of the present invention.

EXAMPLES

To evaluate the effectiveness of the tetra-alkyl guanidine of the present invention, a number of experiments were run. A kerosene which was very difficult to sweeten was used as the reference feed stock. The kerosene contained 180 wt ppm mercaptan sulfur.

The test procedure used was not meant to be indicative of commercial operation, rather it was meant to be a simplified procedure which would quickly separate good alkaline reagents from bad ones. The test procedure was to put 2 grams of impregnated charcoal, equivalent to 13.3 cc by volume, wetted with 5 ml of the alkaline reagent being tested, plus 100 ml of feedstock in several large flasks. A flask size of 250 ml or larger gives reproducible results. The flasks were then capped and placed in an automated shaking device a "Burrell Wrist Action Shaker". Temperature was not measured, but all tests were conducted at ambient temperature in a room maintained at about 25 C, so changes in temperature are not believed to be significant. The contents of the flasks were sampled at uniform intervals, by removing a flask and analyzing the contents and the mercaptan sulfur content of the hydrocarbon determined in that flask. If four flasks are used, one will be removed after 15, 30, 60 and 90 minutes have elapsed.

To insure the validity of the test, a number of blanks were run, i.e., operation with charcoal which contained no metal phthalocyanine catalyst on it, and operation with and without conventional alkaline reagent (aqueous sodium hydroxide solution). The same lot charcoal material was used throughout the test, a vegetable derived charcoal sold by the Westvaco Co. known in the trade as Nuchar WA. The charcoal was impregnated with a cobalt phthalocyanine monosulfonate. The catalyst, 0.15 grams of cobalt phthalocyanine sulfonate, was dispersed in 100 cc of methanol. The cobalt phthalocyanine was difficult to dissolve, so to insure that all of it went into solution, the dissolution proceeded step-wise, i.e., one-fourth of the alcohol was mixed with the phthalocyanine, then decanted, then the next one-fourth portion was added to the cobalt phthalocyanine remaining in the bottom of the flask, with grinding of the cobalt compound. This was repeated a third and a fourth time to make sure that all of the active material was dissolved or dispersed in the alcohol. The alcohol-catalyst dispersion was then placed in a container with 15 grams (100 cc) of charcoal, stirred slightly, and allowed to stand overnight. The alcohol was then drained from the material, and the charcoal dried under a water pump vacuum. The filtrate had only a faint blue color, but did not contain any significant amount of cobalt, so the impregnated charcoal contained 1 wt. % of the cobalt phthalocyanine sulfonate. This was divided into several 2 gram portions for use in carrying out the activity tests.

The oxidizing medium used in the "shake test" was simply the air in the flask. Calculations indicate that the amount of oxygen in the air within the flask is several times that required to completely convert the mercaptan in the particular kerosene being tested to disulfide.

Despite these differences, and despite the fact that the "shake test" operates at ambient temperature whereas commercially the fixed bed sweetening process operates at a somewhat higher temperature, usually 30°-40° C., the test is still a very useful tool. It should not be practical to test a variety of alkaline materials on a commercially sized unit, because most refiners require a certain production of on specification product each day, and cannot tolerate days of unsatisfactory operation. An attempt to duplicate the commercial fixed bed operation in a smaller fixed bed pilot plant is possible, but would require months of operation. This is expensive not only in terms of manpower to operate the plants, but also requires a lot of feed stock which can be expensive to obtain and difficult to store. For these reasons the shake test is routinely used in arriving at a preliminary evaluation of (1) the activity of an unknown catalyst on a support of known characteristics
(2) the characteristics of a support when carrying a catalyst of known characteristics
(3) the relative ease of converting unknown mercaptans in an unfamiliar hydrocarbon feed when using catalyst of known characteristics carried on a support of known characteristics
(4) the relative effect of some reaction conditions, e.g. alkalinity, type of alkali or potential catalyst poisons on conversion of known mercaptans in a known hydrocarbon feed using a catalyst of known characteristics on a support of known characteristics.

In many cases for the same results there is a rough time correspondence between the liquid hourly space velocity in a conventional fixed bed operation and the residence time in the shake test, at least for the initial operating period. To be absolutely conclusive of continuous long term results the "shake test" should be confirmed by continuous operation of a conventional fixed ved unit or a pilot plant having figuration similar to a commercial unit, but the shake test results are always directionally correct and it has proven to be a useful research tool.

In summary four flasks of equal size, e.g. 250 ml, will be placed in a shaking device. Each containing the following materials.

(1) 2.0 grams, or 13.3 cc by volume, of charcoal impregnated to contain 1.0 wt. % cobalt phthalocyanine monosulfonate
(2) 100 ml of feed stock
(3) 5 ml of alkaline reagent
(4) air—in the space between the hydrocarbon surface and the cork stopper in the flask.

In all tests, identical glassware, feed stocks, charcoal and catalyst were used. The only variable in the test was the alkaline reagent, and a few blank tests.

The results of the tests are reported in the following table.

TABLE I

| | INORGANIC BASES | | | | | |
|---|---|---|---|---|---|---|
| TEST | 1 | 2 | 3 | 4 | 5 | 6 |
| Wt. % Cobalt Phthalocyanine on Charcoal | 0 | 1.0 | 1.0 | 1.0 | 1.0 | 1.0 |
| Ml Base | 0 | 0 | 5 | 5 | 5 | 5 |
| Base Description | — | — | *Aqueous NaOH | **Alcoholic NaOH | ***Aqueous $NH_4OH$ | ****Alcoholic $NH_4OH$ |
| | wt - ppm RSH | | | | | |
| Shaking Time (Minutes) | | | | | | |
| 0 | 180 | 180 | 180 | 180 | 180 | 180 |
| 5 | 167 | 158 | 44 | 5 | — | — |
| 15 | 164 | 152 | 16 | 2 | 78 | 44 |
| 30 | 164 | 146 | 11 | 1 | 53 | 38 |
| 60 | 164 | 137 | 7 | 1 | 30 | 33 |
| 90 | — | — | 3 | — | 26 | 22 |
| 120 | — | — | 3 | — | 25 | — |

*1 N NaOH in $H_2O$
**1 N $NaOCH_3$ Solution Made Up Reacting Na Metal With Methyl Alcohol
***1 N $NH_4OH$ In $H_2O$
****1 N $NH_4OH$ Solution Made Up Using Reagent Grade Aqueous $NH_4OH$ and Methyl Alcohol A dash indicates that the mercaptan content was not tested. The results reported under test 3, i.e., use of aqueous NaOH solution, may be considered the standard activity for a conventional fixed bed process. Surprisingly, the use of an alcoholic NaOH solution gives much better results than use of an aqueous NaOH solution; however, the use of an alcoholic sodium hydroxide solution forms no part of the present invention. Not all solutions showed an improvement in going from an aqueous to an alcoholic phase, as can be observed by comparing the results of aqueous $NH_4OH$ to alcoholic $NH_4OH$. The alcoholic $NH_4OH$ appeared to give slightly higher initial activity, but after a 60 minute period, the mercaptan content was 10% higher for the alcoholic solution than for the aqueous solution.

A number of organic bases were tested. The results are presented in Table II.

TABLE II

| TEST | 3 | 7 | ORGANIC BASES 8 | 9 | 10 | |
|---|---|---|---|---|---|---|
| Wt. % Cobalt Phthalocyanine on Charcoal | 1.0 | 1.0 | 1.0 | 1.0 | 1.0 | |
| Ml Base | 5 | 5 | 5 | 5 | 5 | |
| Base Description | Aqueous NaOH | *Alcoholic Diethylamine | **Alcoholic Diethylene-Triamine wt - ppm RSH | ***Alcoholic Tetramethyl-Guanidine | ****Alcoholic Arquad | |
| Shaking time (Minutes) | | | | | | |
| 0 | 180 | 180 | 180 | 180 | 180 | |
| 5 | 44 | | | 8 | 5 | (Hcbn Dark Green) |
| 15 | 16 | 31 | 71 | 7 | 3 | (Hcbn Dark Green) |
| 30 | 11 | 27 | 53 | 5 | 3 | (Hcbn Dark Green) |
| 60 | 7 | 22 | 42 | 3 | 2 | (Hcbn Medium Green) |
| 90 | 3 | 19 | 36 | 3 | 2 | (Hcbn Medium Green) |
| 120 | 3 | | | | | |

*1 N Diethylamine Solution Made Up Using Pure Base And Methyl Alcohol
**1 N Diethylene Triamine Made Up Using Pure Base And Methyl Alcohol
***1 N Tetramethyl-Guanidine Solution Made Up Using Pure Base And Methyl-Alcohol
****1 N Armour ArquadT-50 (Trimethyl Tallow Ammonium Hydroxide) Made Up Using The Base And Methyl Alcohol The process of the present invention is illustrated in the example wherein the base was alcoholic tetramethyl guanidine. The last test, alcoholic trimethyl tallow ammonium hydroxide, is an illustration of a basic medium which does work to convert mercaptan sulfur, but which is not acceptable for use in petroleum refining. The base used in that example imparted a deep green color to the kerosene tested, and resulted in the formation of an emulsion when the kerosene was given the doctor test. Either property alone, i.e., color formation or emulsion formation, would disqualify that particular base from use as a commercial petroleum additive.

Accordingly, it can be seen that the process of the present invention provides a way to treat even difficult to sweeten kerosenes without the use of an aqueous sodium hydroxide solution. Further, the basic reagent of the present invention provides a more effective sweetening process than aqueous NaOH solutions or several organic bases suggested by the prior art.

I claim as my invention:

1. In a process for the sweetening of a sour hydrocarbon distillate containing mercaptans by contact of the distillate in the presence of an oxidizing agent and an alkaline medium with a phthalocyanine catalyst supported on a carbon carrier, the improvement which comprises employing as said alkaline medium a tetra-alkyl guanidine.

2. The improvement of claim 1 wherein the tetra-alkyl guanidine is tetra-methyl guanidine.

3. The improvement of claim 1 wherein the alkaline medium consists of an alcoholic solution of tetra-methyl guanidine.

4. The improvement of claim 3 wherein the alcohol is methyl alcohol.

5. The improvement of claim 1 wherein said distillate is a sour kerosene.

6. The improvement of claim 5 wherein said tetra-alkyl guanidine is employed in an amount of 1 to 500 wt. ppm, based on the kerosene.

* * * * *